US012313084B1

(12) United States Patent
Zhang

(10) Patent No.: US 12,313,084 B1
(45) Date of Patent: May 27, 2025

(54) NECK HANGING FAN

(71) Applicant: Fan Zhang, Shenzhen (CN)

(72) Inventor: Fan Zhang, Shenzhen (CN)

( * ) Notice: Subject to any disclaimer, the term of this patent is extended or adjusted under 35 U.S.C. 154(b) by 0 days.

(21) Appl. No.: 19/006,355

(22) Filed: Dec. 31, 2024

Related U.S. Application Data

(63) Continuation of application No. PCT/CN2024/140141, filed on Dec. 18, 2024.

(30) Foreign Application Priority Data

Nov. 24, 2023 (CN) ..... 202323187099.4

(51) Int. Cl.

| | |
|---|---|
| ***F04D 29/52*** | (2006.01) |
| ***F04D 19/00*** | (2006.01) |
| ***F04D 29/70*** | (2006.01) |
| ***F24F 1/04*** | (2011.01) |

(52) U.S. Cl.
CPC ..... *F04D 29/522* (2013.01); *F04D 19/002* (2013.01); *F04D 29/703* (2013.01); *F24F 1/04* (2013.01); *F24F 2221/38* (2013.01)

(58) Field of Classification Search
CPC .... F04D 29/522; F04D 19/002; F04D 29/703; F24F 1/04; F24F 2221/38
See application file for complete search history.

(56) References Cited

U.S. PATENT DOCUMENTS

2022/0235786 A1* 7/2022 Liu ..... F04D 29/281

* cited by examiner

*Primary Examiner* — Aaron R Eastman
(74) *Attorney, Agent, or Firm* — JEEN IP LAW, LLC

(57) ABSTRACT

A neck hanging fan is provided, which includes a bracket that can be worn on a human's neck. The bracket includes extension arms located on two sides of the human's neck, extension ends of the extension arms are provided with a wind duct. The wind duct is provided with an air channel and a fan component. One end of the wind duct away from the extension arms is provided with an air inlet, an air outlet is provided at a connection between the wind duct and the extension arms. The fan component is located between the air inlet and the air outlet, and the air inlet is provided with an air inlet mesh cover. The air inlet mesh cover is provided with a plurality of first air guide holes, the air outlet is provided with an air outlet mesh cover.

10 Claims, 9 Drawing Sheets

NECK HANGING FAN

CROSS-REFERENCE TO RELATED APPLICATIONS

This application is a continuation of International Application No. PCT/CN2024/140141, filed on Dec. 18, 2024, which claims priority to Chinese Patent Application No. 202323187099.4, filed with the China National Intellectual Property Administration on Nov. 24, 2023. Both of which are hereby incorporated by reference in their entireties.

TECHNICAL FIELD

The present disclosure relates to the field of fan technologies, and in particular, to a neck hanging fan.

BACKGROUND

A neck hanging fan is a hair blowing device that can be worn around a user's neck, can move with the user, and can release the user's hands to blow air towards the face and human's neck, thereby achieving a purpose of cooling and dissipating heat.

The neck hanging fan generally includes a bracket that can be worn on the human's neck. The bracket has wind ducts located on two sides of the human's neck. The wind ducts are equipped with air channels and fan components, and the wind ducts are equipped with air inlets and air outlets. The fan components suck in external air from the air inlets and transport it to the air channels, and finally blow it out from the air outlets. However, due to a poor airflow of traditional neck hanging fans, the blowing effect is not satisfactory.

SUMMARY

The present disclosure addresses the shortcomings of existing technology and provides a neck hanging fan that can guide air, rendering it has directionality, smoother inlet and outlet air, and better blowing effect.

To achieve the above objectives, the present disclosure adopts the following technical solution.

A neck hanging fan, including a bracket that is capable of being worn on a human's neck, the bracket includes extension arms located on two sides of the human's neck, where extended ends of the extension arms are provided with a wind duct, and the wind duct includes an air channel and a fan assembly; one end of the wind duct far away from the extension arms is provided with an air inlet, and an air outlet is provided at a connection between the wind duct and the extension arms; the fan assembly is located between the air inlet and the air outlet, the air inlet is provided with an air inlet mesh cover, and the air inlet mesh cover is provided with a plurality of first air guide holes; the air outlet is provided with an air outlet mesh cover, and the air outlet mesh cover is provided with a plurality of second air guide holes; the first air guide holes, the air channel, and the second air guide holes are sequentially communicated.

By providing the wind duct at the extended ends of the extension arms, the air channel and the fan assembly are provided in the wind duct. One end of the wind duct far away from the extension arms is provided with the air inlet, and the air outlet is provided at the connection between the wind duct and the extension arms. The air inlet is provided with an air inlet mesh cover, and the air inlet mesh cover is provided with a plurality of first air guide holes. The air outlet is provided with the air outlet mesh cover, and the air outlet mesh cover is provided with a plurality of second air guide holes. When in use, the fan assembly sucks in external air from the first air guide holes, sucked air flows along the air channel to the air outlet mesh cover, and finally blows out from the second air guide holes. The air is guided by the first and second air guide holes, it is caused to have directionality. The air inlet and air outlet are smoother, and the blowing effect is better.

In some embodiments of the present disclosure, the extension arms and the wind duct are formed by cutting off an inner curved wall of an arc-shaped curved pipe, and an opening is formed at inner curved parts of the extension arms; a cutting depth of the opening at one end away from the wind duct is greater than a cutting depth of the opening at one end close to the wind duct; remaining internal space of the arc-shaped curved pipe after being cut off forms an air guide groove.

In some embodiments of the present disclosure, an inner wall of the air guide groove is in a smooth shape.

In some embodiments of the present disclosure, a depth of the air guide groove is gradually decreased along a direction of air flow.

In some embodiments of the present disclosure, the second air guide holes blow air in a direction close to the human's neck, and an angle 3 between an air outlet direction of the second air guide holes and an air outlet direction of the air outlet is an acute angle.

In some embodiments of the present disclosure, the air outlet mesh cover includes a plurality of air guide rings and a plurality of air guide plates, adjacent two air guide rings are spaced apart to form an annular ventilation groove, the plurality of air guide plates are distributed in a circular manner; the air guide plates are extended radially outward through the air guide rings and the annular ventilation groove, the second air guide holes are formed by surrounding adjacent two air guide plates and adjacent two air guide rings.

In some embodiments of the present disclosure, a connection part is provided in a middle of the bracket, at least one neck support protrudes on one side of the connection part facing the human's neck.

In some embodiments of the present disclosure, the connection part is a flexible connection part, and two ends of the flexible connection part are respectively connected to the corresponding extension arms.

In some embodiments of the present disclosure, an arc-shaped connection plate and an arc-shaped slot are provided between the extension arms and the connection part, the arc-shaped connection plate is provided in the arc-shaped slot to render the extension arms to move close to or away from the connection part.

In some embodiments of the present disclosure, a storage chamber is provided on the extension arms or the wind duct, and the storage chamber is provided with a battery and a circuit board.

In some embodiments of the present disclosure, a motor on the fan component is provided on the air outlet mesh cover.

A neck hanging fan, including a bracket that is capable of being worn on a human's neck, where at least one neck support is provided on one side of the bracket facing the neck, when worn, a surface of the neck support away from the bracket is adhered to the neck.

In some embodiments of the present disclosure, the neck support includes an installation seat and a fitting piece, the installation seat is connected to the bracket, and the fitting piece is provided on one side of the installation seat away from the bracket.

In some embodiments of the present disclosure, a first arc-shaped fitting surface is formed on one side of the fitting piece away from the bracket, and the first arc-shaped fitting surface is protruded toward a direction close to the bracket.

In some embodiments of the present disclosure, the installation seat is connected to the bracket, the bracket is provided with at least one clamp block, and the installation seat is provided with a clamp hole, the clamp block is cooperated with the clamp hole to connect the installation seat to the bracket.

In some embodiments of the present disclosure, an abutting plate is provided between the installation seat and the fitting piece, the abutting plate is connected to the installation seat, the fitting piece is attached to one side of the abutting plate that is close to the installation seat; the abutting plate is provided with an elastic block, the elastic block abuts against the clamp block to limit a movement of the installation seat towards or away from the bracket.

Compared with the prior art, the present disclosure has obvious advantages and beneficial effects. Specifically, by proving the wind duct at extension ends of the extension arms, the air channel and the fan component are provided in the wind duct, the air inlet is provided at one end of the wind duct away from the extension arms, and the air outlet is provided at the connection between the wind duct and the extension arms. The air inlet is provided with the air inlet mesh cover, and the air inlet mesh cover is provided with a plurality of first air guide holes. The air outlet is provided with the air outlet mesh cover, and the air outlet mesh cover is provided with a plurality of second air guide holes. When in use, the fan component sucks in external air from the first air guide holes, and sucked air flows along the air channel to the air outlet mesh cover, and finally blows out from the second air guide holes, with the first air guide holes and the second air guide holes, the air is guided, rendering it has directionality, smoother air intake and exhaust, and better blowing effect.

To provide a clearer explanation of the structural features, technical solution, specific objectives, and functions of the present disclosure, the following will provide a further detailed description of the present disclosure in combination with the accompanying drawings and specific embodiments.

Figure 1:
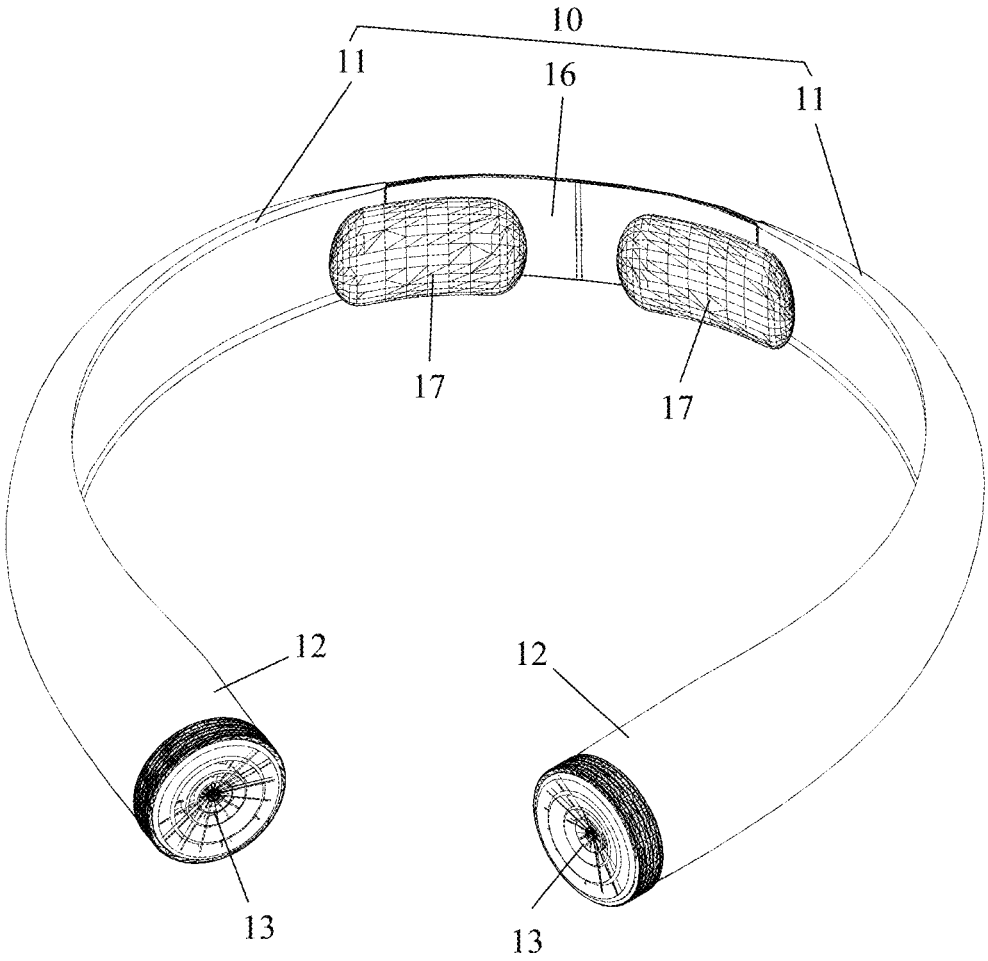
FIG. 1 is a schematic diagram of an assembly structure of a first embodiment of the present disclosure.
Figure 2:
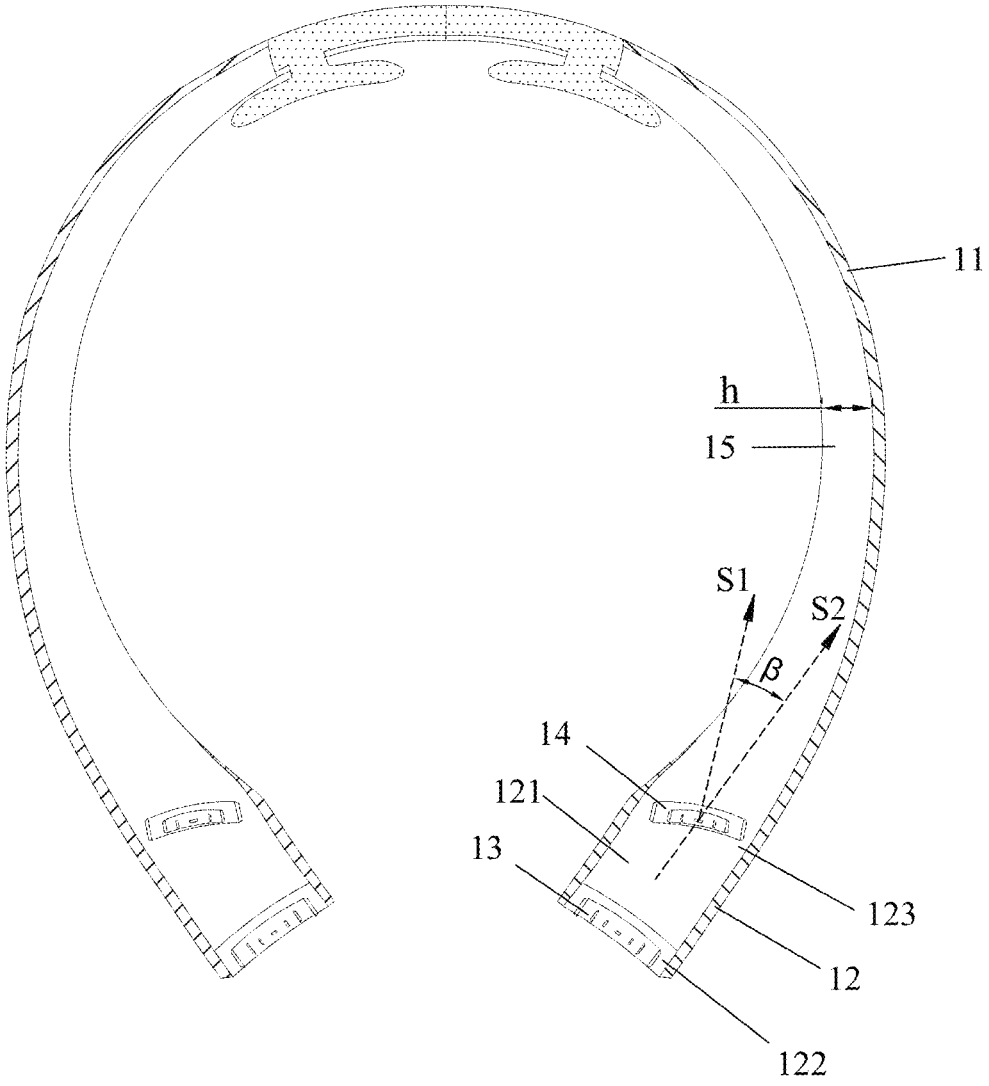
FIG. 2 is a schematic cross-sectional view of the first embodiment of the present disclosure.
Figure 3:
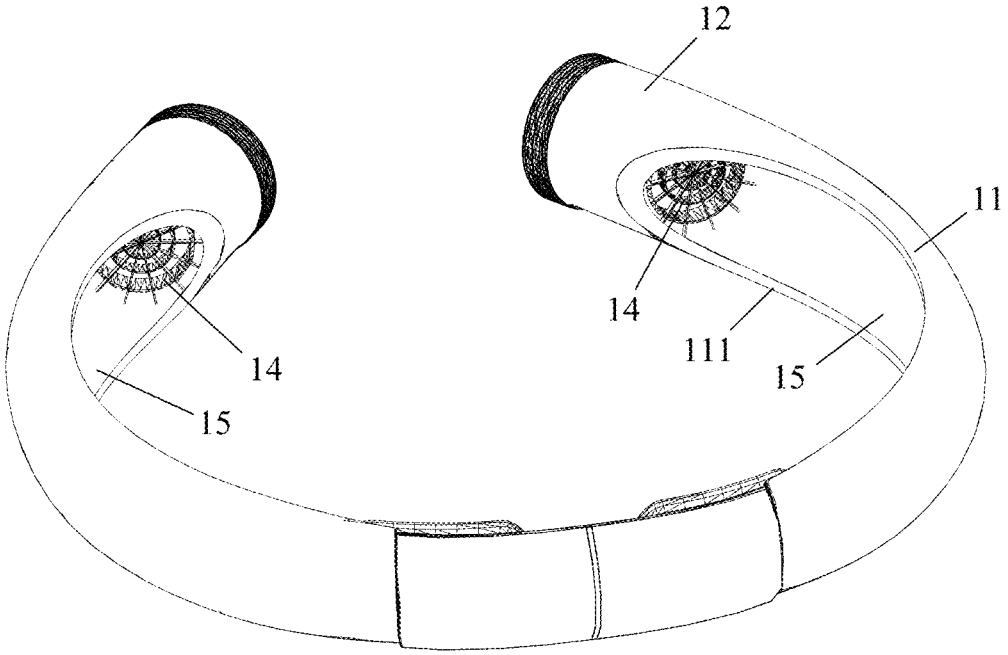
FIG. 3 is a schematic structural diagram of the first embodiment of the present disclosure from another perspective.
Figure 4:
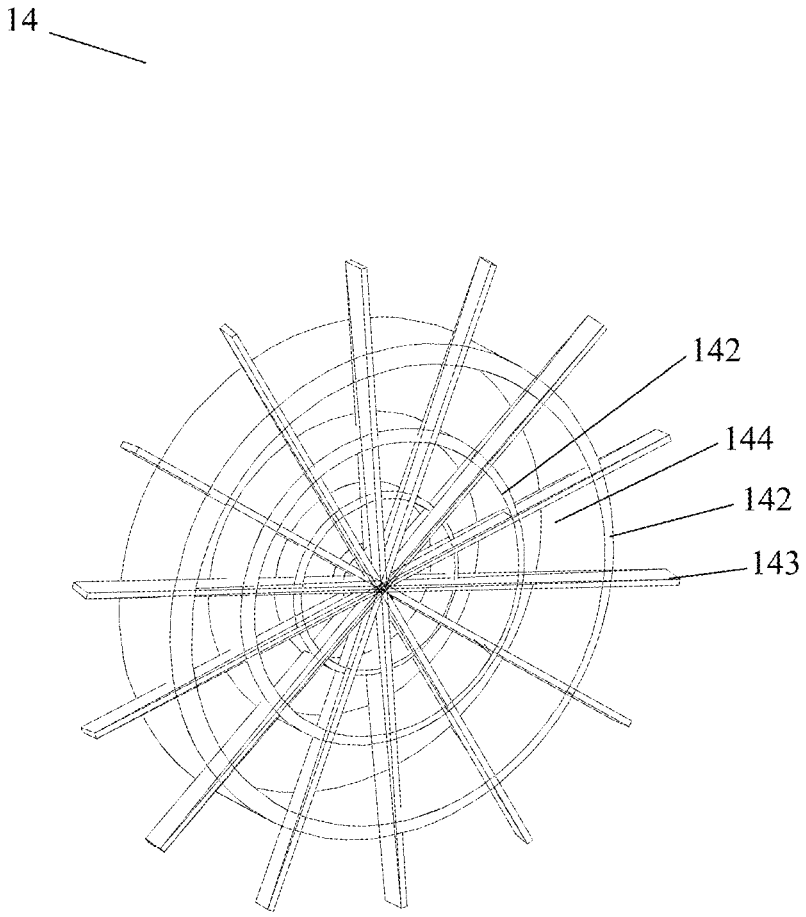
FIG. 4 is a schematic structural diagram of an air outlet mesh cover in the first embodiment of the present disclosure.
Figure 5:
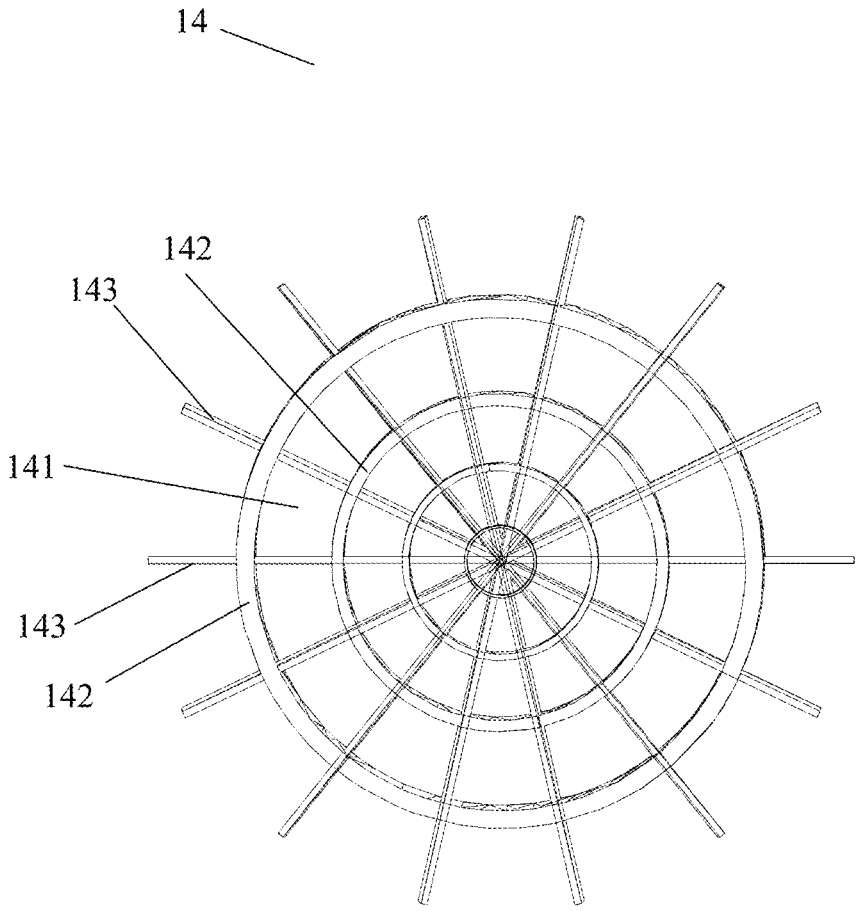
FIG. 5 is a front view of the air outlet mesh cover of the first embodiment of the present disclosure.
Figure 6:
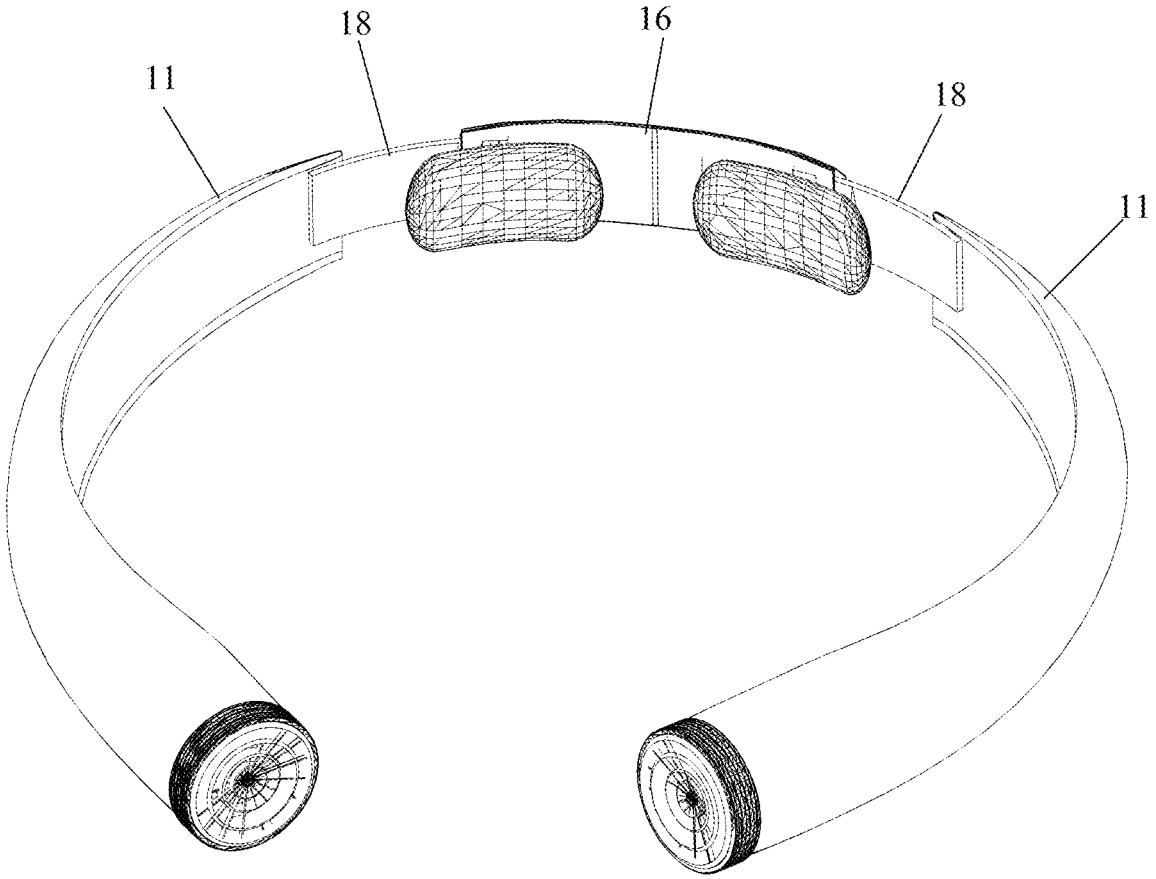
FIG. 6 is a schematic diagram of a usage state of the first embodiment of the present disclosure.

Numeral reference: 10 bracket, 11 extension arm, 111 opening, 12 wind duct, 121 air channel, 122 air inlet, 123 air outlet, 13 air inlet mesh cover, 14 air outlet mesh cover, 141 second air guide hole, 142 air guide ring, 143 air guide plate, 144 annular ventilation groove, 15 air guide groove, 16 connection part, 17 neck support, 18 connection plate, 30 neck support, 31 installation seat, 311 clamp hole, 312 positioning hole, 313 annular groove, 32 fitting piece, 321 first arc-shaped fitting surface, 322 first bordure, 33 abutting plate, 331 first elastic block, 332 first avoidance groove, 333 second arc-shaped fitting surface, 334 second bordure, 335 second elastic block, 336 second avoidance groove.

DESCRIPTION OF EMBODIMENTS

In the description of the present disclosure, it should be noted that terms "center", "up", "down", "left", "right", "vertical", "horizontal", "inside", "outside" and other directional or positional relationships indicated are based on the directional or positional relationships shown in the accompanying drawings, only for the convenience of describing the present disclosure and simplifying the description, and do not indicate or imply that the referred position or element must have a specific orientation, be constructed and operated in a specific orientation, and therefore cannot be understood as limiting the present disclosure.

In the description of the present disclosure, it should be noted that unless otherwise specified and limited, terms "installation", "connection to", and "connection with" should be broadly understood, for example, it can be a fixed connection, a detachable connections, or an integral connection; it can be a mechanical connection or an electrical connection; it can be directly connected, indirectly connected through an intermediate medium, or connected internally between two components. For those skilled in the art, the specific meanings of the above terms in the present disclosure can be understood according to the specific situation.

As shown in FIGS. 1-6, the present disclosure discloses a neck hanging fan, including a bracket 10 that can be worn on a human's neck, where the bracket 10 has extension arms 11 located on two sides of the human's neck.

Extension ends of the extension arms 11 are provided with a hollow wind duct 12, and the extension arms 11 are integrally formed with the wind duct 12. An air channel 121 and a fan component (not shown) are provided in the wind duct 12. One end of the wind duct 12 away from the extension arms 11 is provided with an air inlet 122, and an air outlet 123 is provided at a connection between the wind duct 12 and the extension arms 11. The fan component is provided between the air inlet 122 and the air outlet 123; the air inlet 122 is provided with an air inlet mesh cover 13, and the air inlet mesh cover 13 is provided with a plurality of first air guide holes (not shown). The air outlet 123 is provided with an air outlet mesh cover 14, and the air outlet mesh cover 14 is provided with a plurality of first air guide holes (not shown). The first air guide holes, the air channel 121, and the second air guide holes 141 are sequentially communicated.

The extension arms 11 and the wind duct 12 are a structure formed by cutting off an inner curved wall of an arc-shaped curved pipe. An opening 111 is formed at inner curved parts of the extension arms 11. A cutting depth of the opening 111 at one end away from the wind duct 12 is greater than a cutting depth of the opening 111 at one end close to the wind duct 12. A direction of the cutting depth of the opening 111 is defined as one direction away from the human' neck. After the arc-shaped curved pipe is cut, remaining internal space thereof forms an air guide groove 15. By using the air guide groove 15, during use, a portion of air blown out by the second air guide holes 141 flows along the air guide groove 15 and blows towards the human's neck, resulting in a better heat dissipation effect on the human's neck.

An inner wall of the air guide groove 15 is arranged in a smooth shape. By using the air guide groove 15 with a smooth inner wall, air circulation in the air guide groove 15 is smoother and the blowing effect is better.

A curvature of the air guide groove 15 along length directions of the extension arms 11 is not less than 30 radians, where radians=arc length/radius.

A depth h of the air guide groove 15 is gradually decreased along a direction of air flow, and the depth h of the air guide groove 15 is defined as a distance at which the air guide groove 15 is recessed away from the human's neck. By setting the depth of the air guide groove 15 to be gradually decreased along the direction of air flow, a consistency of air pressure throughout the air guide groove 15 is improved, resulting in more uniform blowing.

The second air guide hole 141 blows air towards the human's neck, and an angle β between an air outlet direction S1 of the second air guide holes 141 and an air outlet direction S2 of the air outlet 123 is an acute angle, and the angle β ranges from 1° to 60°.

The air outlet mesh cover 14 has a plurality of air guide rings 142 and a plurality of air guide plates 143. Center points of the plurality of air guide rings 142 are on the same straight line, and diameters of the air guide rings 142 are gradually increased from inside to outside. Adjacent two air guide rings 142 are spaced apart to form an annular ventilation groove 144. The plurality of air guide plates 143 are distributed in a circular manner, and the air guide plates 143 are extended radially outward through the air guide rings 142 and the annular ventilation groove 144. The second air guide holes 141 are formed by surrounding adjacent two air guide plates 143 and adjacent two air guide rings 142, and there are at least three air guide rings 142. By providing the air outlet mesh cover 14 composed of the plurality of air guide rings 142 and the plurality of air guide plates 143, adjacent two air guide rings 142 form the annular ventilation groove 144, and the plurality of air guide plates 143 are distributed in a circular manner. The second air guide holes 141 are formed by surrounding adjacent two air guide plates 143 and adjacent two air guide rings 142. When air passes through the second air guide holes 141, the air is guided by both the air guide rings 142 and the air guide plates 143, so that the air has directionality and the air outlet is smooth.

The air inlet mesh cover 13 has a same structure as that of the air outlet mesh cover 14, so it will not be repeated.

A middle of the bracket 10 is provided with a connection part 16, and at least one neck support 17 is protruded on one side of the connection part 16 facing the human's neck. In an implementation mode, there are two neck supports 17. By providing the neck support 17, a contact area between the neck hanging fan and the human's neck can be reduced, rendering it more comfortable for a user to wear.

An arc-shaped connection plate 18 and an arc-shaped slot (not shown) are provided between the extension arms 11 and the connection part 16. The arc-shaped connection plate 18 is extendable and movable in the arc-shaped slot to allow the extension arms 11 to move close to or far away from the connection part 16. By providing the arc-shaped connection plate 18 and the arc-shaped slot, the arc-shaped connection plate 18 can be movably provided in the arc-shaped slot to achieve the extension arms 11 and the connection part 16 to move towards or away from each other, thereby adjusting a blowing angle and achieving a better blowing effect.

The arc-shaped connection plate 18 is a rack, the rack is extended in an arc-shaped manner. A limit block (not shown) is provided in the arc-shaped slot, the limit block is clamped with the rack to limit relative movements of the extension arms 11 to the connection part 16. The arc-shaped connection plate 18 is provided on the connection part 16, and the arc-shaped slot is provided on the extension arms 11. It can be understood that positions of the arc-shaped connection plate 18 and the arc-shaped slot are interchangeable. When in use, the limit block is clamped with the rack to keep the arc-shaped connection plate 18 in any position, thereby achieving static movements of the extension arms 11 relative to the connection part 16 and adjusting positions and angles of the extension arms 11.

It should be noted that the arc-shaped connection plate 18 is interfence fit with the arc-shaped slot, with a frictional force between the arc-shaped connection plate 18 and an inner wall of the arc-shaped slot to keep the arc-shaped connection plate 18 in any position and achieve telescopic adjustments of the extension arms 11.

A storage chamber (not shown) is provided on the extension arms 11 or the wind duct, the storage chamber includes a battery (not shown) and a circuit board (not shown). Motors on the battery and the fan component are both electrically connected to the circuit board.

The motor on the fan component is provided on the air outlet mesh cover 14.

In a second embodiment, the connection part 16 is a flexible connection part 16, and two ends of the flexible connection part 16 are respectively connected to the corresponding extension arms 11. By providing the flexible connection part 16, two extension arms 11 are bridged through the flexible connection part 16. The flexible connection part 16 itself has flexible characteristics and can be bent to different degrees according to different users's needs, so that the two extension arms 11 can be adjusted to approach or move away, and the blowing angle can be adjusted to achieve better blowing effect.

Figure 7:
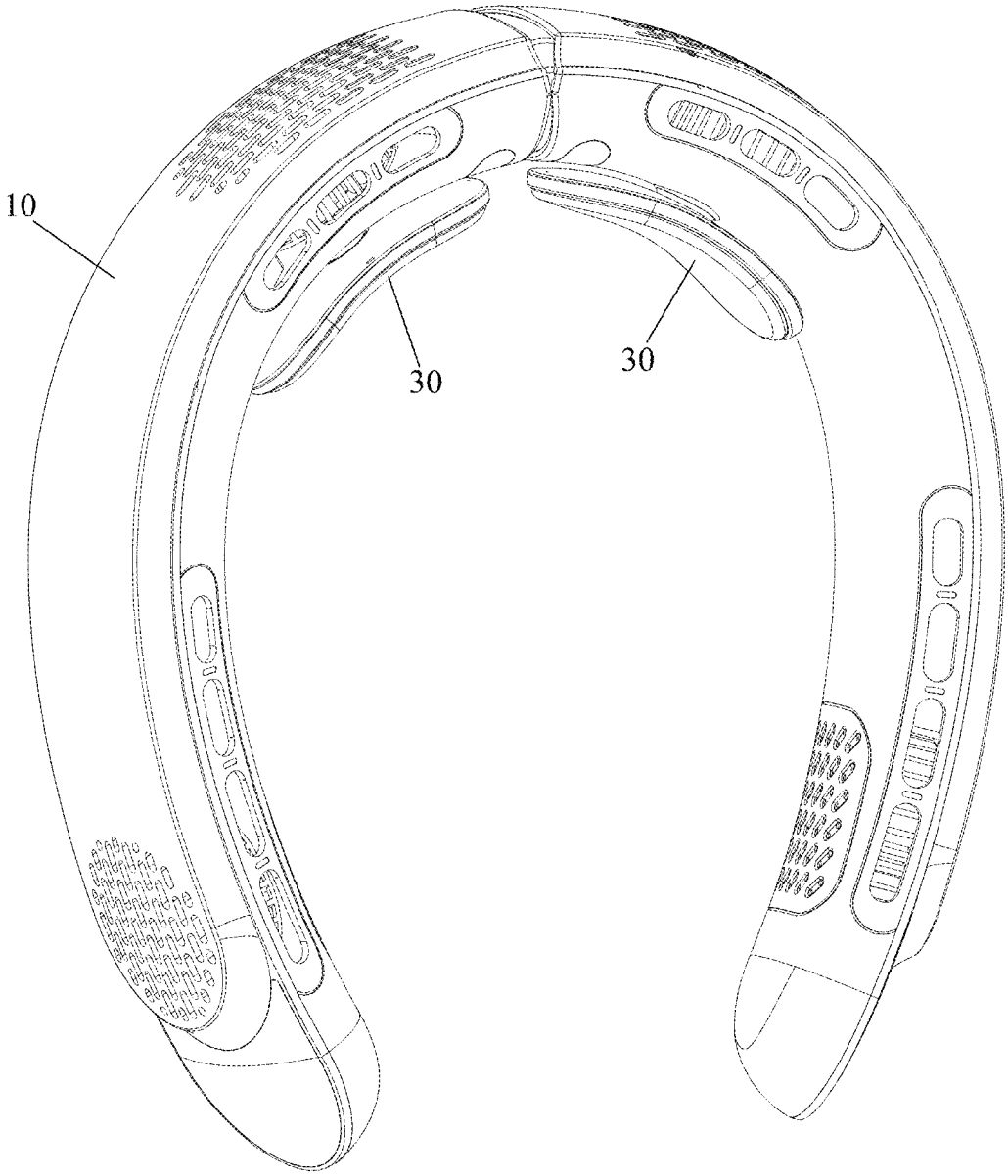
FIG. 7 is a schematic diagram of an assembly of a neck support and a bracket in the first embodiment of the present disclosure.
Figure 8:
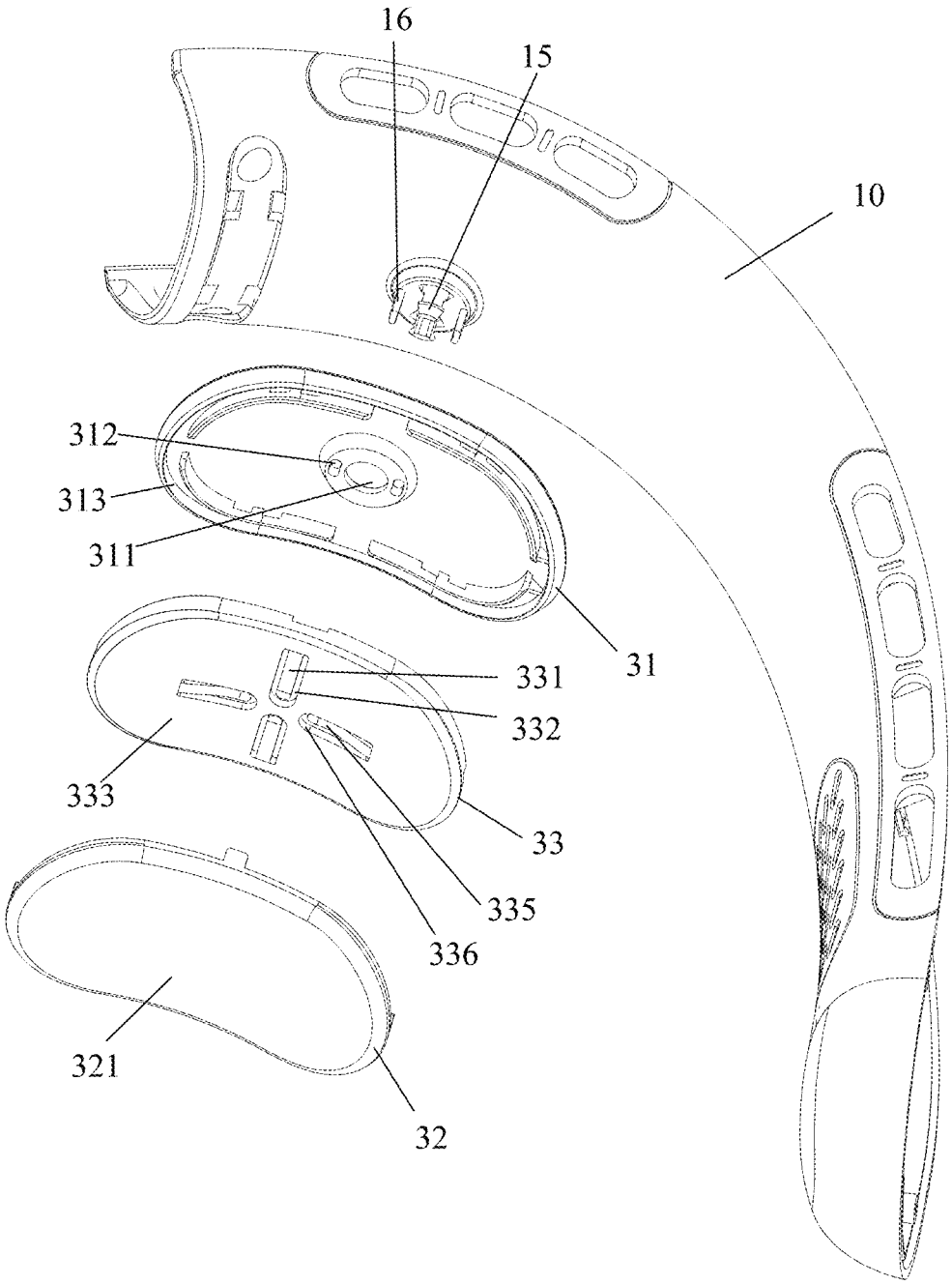
FIG. 8 is an exploded schematic diagram of the neck support and the bracket of the first embodiment of the present disclosure.
Figure 9:
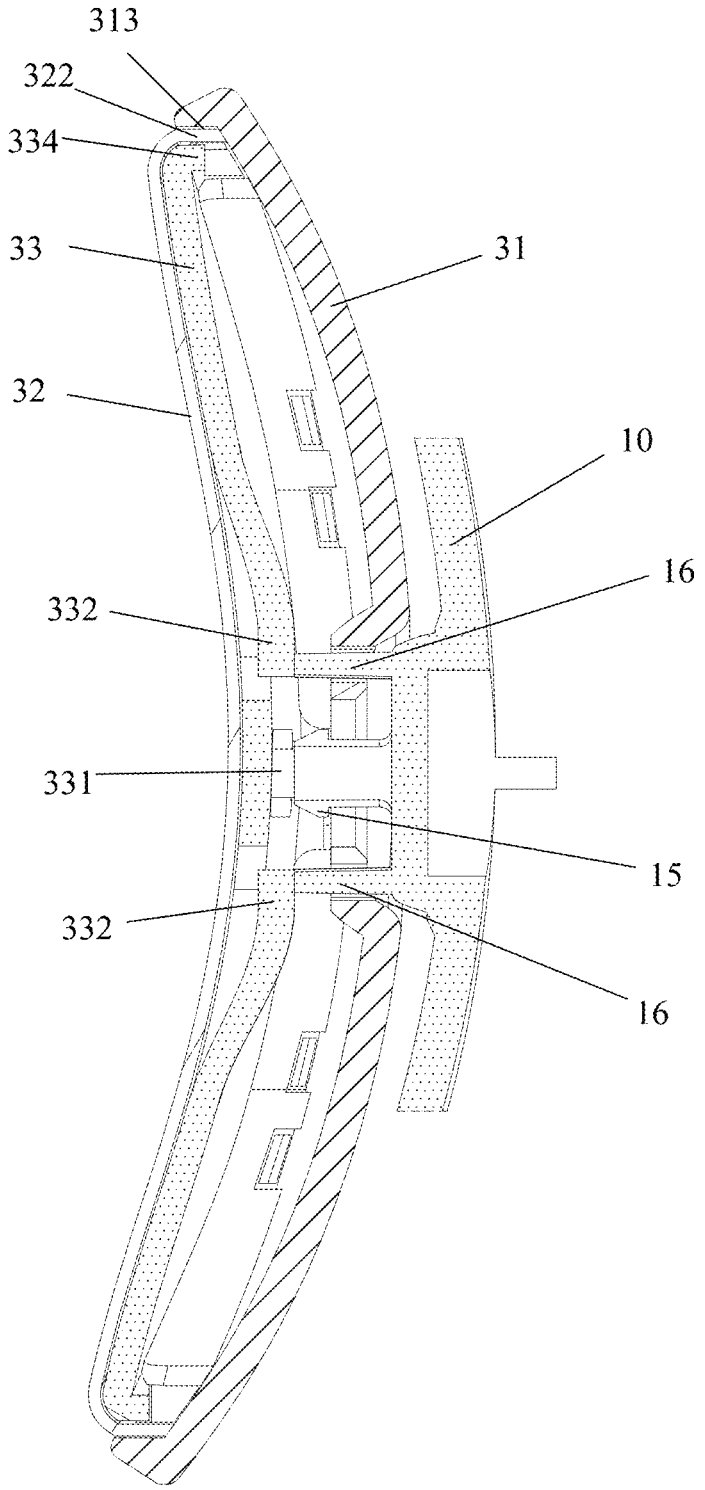
FIG. 9 is a schematic cross-sectional view of the neck support in the first embodiment of the present disclosure.

As shown in FIGS. 7-9, the present disclosure further discloses a neck hanging fan, including a bracket 10 that can be worn on a human's neck. At least one neck support 30 is provided on one side of the bracket 10 facing the neck. In an implementation mode, there are two neck supports 30. When worn, a surface of the neck support 30 on one side away from the bracket 10 is attached to the neck. By providing the neck support 30 on the side of the bracket 10 facing the neck, when worn, the surface of the neck support 30 on the side away from the bracket 10 is adhered to the neck, thereby separating the bracket 10 from the neck and reducing a transmission of vibration generated by the bracket 10 to the neck, rendering it more comfortable to use.

The neck support 30 includes an installation seat 31 and a fitting piece 32. The installation seat 31 is connected to the bracket 10; the fitting piece 32 is provided on one side of the installation seat 31 away from the bracket 10. In an implementation mode, the fitting piece 32 can be formed from soft rubber material or sponge material. By providing the neck support 30 consisting of the installation seat 31 and the fitting piece 32, a split type design is adopted, which has a simple structure, easy processing, and low cost.

The fitting piece 32 has a first arc-shaped fitting surface 321 formed on one side away from the bracket 10, and the first arc-shaped fitting surface 321 protrudes towards a direction close to the bracket 10. By providing the first arc-shaped fitting surface 321 on the fitting piece 32, the arc-shaped fitting surface fits the neck when worn, which conforms to ergonomics and is more comfortable to wear.

The installation seat 31 is connected to the bracket 10 via a snap fastener; by providing the installation seat 31 and the bracket 10 to be connected by a snap fastener, assembly and disassembly are convenient.

At least one clamp block is provided on the bracket 10. In an implementation mode, there are two clamp blocks 15. The installation seat 31 is provided with a clamp hole 311, and the clamp block is cooperated with the clamp hole 311 to connect the installation seat 31 with the bracket 10. During assembly, the clamp block 15 is extended from one end of the clamp hole 311 and extended out of the other end of the clamp hole 311 to clamp the installation seat 31.

An abutting plate 33 is provided between the installation seat 31 and the fitting piece 32, the abutting plate 33 is connected to the installation seat 31. The fitting piece 32 is attached to the abutting plate 33 on one side close to the installation seat 31. The abutting plate 33 is provided with a first elastic block 331, the first elastic block 331 abuts against the clamp block 15 to limit a relative movement of the installation seat 31 towards or away from the wind duct 10. In an implementation mode, the abutting plate 33 is provided with a first avoidance groove 332, and the elastic block 331 is elastically deformable and is provided in the first avoidance groove 332. By providing the abutting plate 33 and providing the first elastic block 331 on the abutting plate 33, the first elastic block 331 abuts against the clamp block 15, thereby limiting the relative movement of the installation seat 31 towards or away from the wind duct 10, thereby improving the installation stability of the neck support 30. One side of the fitting piece 32 close to the installation seat 31 is attached to the abutting plate 33, so that the fitting piece 32 is supported.

One side of the abutting plate 33 facing the fitting piece 32 is provided with a second arc-shaped fitting surface 333; the second arc-shaped fitting surface 333 is protruded in a same direction as the first arc-shaped fitting surface 321, and has the same curvature as the first arc-shaped fitting surface 321. The fitting piece 32 is attached to the second arc-shaped fitting surface 333 on one side close to the installation seat 31. By providing the second arc-shaped fitting surface 333 on the side of the abutting plate 33 facing the fitting piece 32, a protrusion direction of the second arc-shaped fitting surface 333 is the same as that of the first arc-shaped fitting surface 321, and a curvature of the second arc-shaped fitting surface 333 is the same as that of the first arc-shaped fitting surface 321, so that when the fitting piece 32 is attached to the second arc-shaped fitting surface 333 on the side close to the installation seat 31, the fitting piece 32 is not easily deformed.

The abutting plate 33 is connected to the installation seat 31 by a snap fastener. By using a buckle connection way, it is convenient to assemble and disassemble the abutting plate 33 and the installation seat 31.

A circumferential edge of the fitting piece 32 is provided with a first bordure 322, a circumferential edge of the abutting plate 33 is provided with a second bordure 334, and one side of the installation seat 31 away from the bracket 10 is provided with an annular groove 313. The first bordure 322 and the second bordure 334 are both provided in the annular groove 313. An outer wall of the first bordure 322 abuts against an inner wall of the annular groove 313, an inner wall of the first bordure 322 abuts against an outer wall of the second bordure 334. By providing the first bordure 322 on the circumferential edge of the fitting piece 32, the second bordure 334 on the circumferential edge of the abutting plate 33, and the annular groove 313 on the side of the installation seat 31 away from the bracket 10, the first bordure 322 and the second bordure 334 are inserted into the annular groove 313, so that the inner wall of the annular groove 313 abuts against the outer wall of the first bordure 322, and the inner wall of the first bordure 322 abuts against the outer wall of the second bordure 334, thereby preventing the fitting piece 32 from falling off from the installation seat 31. The use of a clamping way for assembly and disassembly is easy to maintain.

At least one positioning column 16 is further provided on the bracket 10. In an implementation mode, there are two positioning columns 16. The installation seat 31 is provided with a positioning hole 312. During assembly, the positioning column 16 is inserted into the positioning hole 312 to limit the relative rotation of the installation seat 31 with respect to the bracket 10. One end of the positioning column 16 far away from the bracket 10 runs through the positioning hole 312 and abuts against the second elastic block 335 on the abutting plate 33. In an implementation mode, the abutting plate 33 is further provided with a second avoidance groove 336, and the second elastic block 335 is elastically deformable and provided in the second avoidance groove 336.

In summary, the present disclosure provides the wind duct 12 at the extended ends of the extension arms 11, the air channel 121 and the fan assembly are provided in the wind duct 12, the air inlet 122 is provided at the end of the wind duct 12 away from the extension arms 11, the air outlet 123 is provided at the connection between the wind duct 12 and the extension arms 11; the air inlet mesh cover 13 is provided at the air inlet 122. The air inlet mesh cover 13 is provided with a plurality of first air guide holes, the air outlet 123 is provided with the air outlet mesh cover 14, and the air outlet mesh cover 14 is provided with a plurality of second air guide holes 141. When in use, the fan assembly sucks in external air from the first air guide holes, and sucked air flows along the air channel 121 to the air outlet mesh cover 14, and finally blows out from the second air guide holes 141. The air guide holes and the second air guide holes 141 guide the air to have directionality, rendering the air inlet and outlet smoother and achieving better blowing effect.

The above description is only a preferred embodiment of the present disclosure and is not intended to limit the present disclosure. Therefore, any modifications, equivalent substitutions, improvements, etc. made to the above embodiments based on the actual technology of the present disclosure still fall within the scope of the technical solution of the present disclosure.

What is claimed is:

1. A neck hanging fan, comprising: a bracket that is capable of being worn on a human's neck, the bracket comprises extension arms located on two sides of the human's neck, wherein extended ends of the extension arms are provided with a wind duct, and the wind duct comprises an air channel and a fan assembly;

one end of the wind duct far away from the extension arms is provided with an air inlet, and an air outlet is provided at a connection between the wind duct and the extension arms;

the fan assembly is located between the air inlet and the air outlet, the air inlet is provided with an air inlet mesh cover, and the air inlet mesh cover is provided with a plurality of first air guide holes;

the air outlet is provided with an air outlet mesh cover, and the air outlet mesh cover is provided with a plurality of second air guide holes;

the first air guide holes, the air channel, and the second air guide holes are sequentially communicated;

wherein the extension arms and the wind duct are formed by cutting off an inner curved wall of an arc-shaped curved pipe, and an opening is formed at inner curved parts of the extension arms;

a cutting depth of the opening at one end away from the wind duct is greater than a cutting depth of the opening at one end close to the wind duct;

remaining internal space of the arc-shaped curved pipe after being cut off forms an air guide groove.

2. The neck hanging fan according to claim 1, wherein an inner wall of the air guide groove is in a smooth shape.

3. The neck hanging fan according to claim 1, wherein a depth of the air guide groove is gradually decreased along a direction of air flow.

4. The neck hanging fan according to claim 1, wherein the second air guide holes blow air in a direction close to the human's neck, and an angle β between an air outlet direction of the second air guide holes and an air outlet direction of the air outlet is an acute angle.

5. The neck hanging fan according to claim 1, wherein the air outlet mesh cover comprises a plurality of air guide rings and a plurality of air guide plates, adjacent two air guide rings are spaced apart to form an annular ventilation groove, the plurality of air guide plates are distributed in a circular manner;

the air guide plates are extended radially outward through the air guide rings and the annular ventilation groove, the second air guide holes are formed by surrounding adjacent two air guide plates and adjacent two air guide rings.

6. The neck hanging fan according to claim 1, wherein a connection part is provided in a middle of the bracket, at least one neck support protrudes on one side of the connection part facing the human's neck.

7. The neck hanging fan according to claim 6, wherein the connection part is a flexible connection part, and two ends of the flexible connection part are respectively connected to the corresponding extension arms.

8. The neck hanging fan according to claim 6, wherein an arc-shaped connection plate and an arc-shaped slot are provided between the extension arms and the connection part, the arc-shaped connection plate is provided in the arc-shaped slot to render the extension arms to move close to or away from the connection part.

9. The neck hanging fan according to claim 1, wherein a storage chamber is provided on the extension arms or the wind duct, and the storage chamber is provided with a battery and a circuit board.

10. The neck hanging fan according to claim 1, wherein a motor on the fan component is provided on the air outlet mesh cover.

* * * * *